US011312097B2

(12) United States Patent
Tanaka et al.

(10) Patent No.: US 11,312,097 B2
(45) Date of Patent: Apr. 26, 2022

(54) BLANK FOR FORMING A CONTAINER

(71) Applicant: JT International S.A., Geneva (CH)

(72) Inventors: Kenta Tanaka, Shizuoka (JP); Dominic Lukasz Latuszek, Trier (DE); Mike Clausen, Schloss Holte-Stukenbrock (DE)

(73) Assignee: JT International S.A.

( * ) Notice: Subject to any disclaimer, the term of this patent is extended or adjusted under 35 U.S.C. 154(b) by 145 days.

(21) Appl. No.: 16/323,407

(22) PCT Filed: Sep. 26, 2017

(86) PCT No.: PCT/EP2017/074310
§ 371 (c)(1),
(2) Date: Feb. 5, 2019

(87) PCT Pub. No.: WO2018/060168
PCT Pub. Date: Apr. 5, 2018

(65) Prior Publication Data

US 2019/0176430 A1 Jun. 13, 2019

(30) Foreign Application Priority Data

Sep. 28, 2016 (EP) ..... 16191136

(51) Int. Cl.
*B31B 50/88* (2017.01)
*B31B 50/62* (2017.01)
(Continued)

(52) U.S. Cl.
CPC ..... *B31B 50/624* (2017.08); *B31B 50/74* (2017.08); *B31B 50/745* (2017.08); *B31B 50/88* (2017.08);
(Continued)

(58) Field of Classification Search
CPC ..... B31B 50/624; B31B 50/74; B31B 50/742; B31B 50/747; B31B 50/756; B31B 50/88; B31B 2100/00; B31B 2241/003
See application file for complete search history.

(56) References Cited

U.S. PATENT DOCUMENTS 5,088,643 A * 2/1992 Frazier ..... B29C 59/08 229/125.15
2002/0142904 A1 10/2002 Zumbiel
(Continued)

OTHER PUBLICATIONS

Extended European Search Report including Written Opinion for Application No. EP16191136.7 dated Mar. 27, 2017.
(Continued)

*Primary Examiner* — Chelsea E Stinson
(74) *Attorney, Agent, or Firm* — Lerner, David, Littenberg, Krumholz & Mentlik, LLP

(57) ABSTRACT

A blank has an upper surface and a reverse surface. The upper surface is printed in a conventional manner and includes outer side panels and inner side panels. Attachment regions are provided on the inner side panels of the outer surface, and corresponding attachment regions are provided on the outer side panels of the reverse surface. During assembly the respective attachment regions are arranged to face one another and an adhesive is provided therebetween. In the present method, the attachment regions of the upper surface initially have a surface tension in the range from around 34 dynes/cm to 60 dynes/cm before the upper surface is printed. The attachment regions are treated in order to maintain a surface tension in the desired range of 34 dynes/cm to 60 dynes/cm, following printing and before any adhesive is applied. This is achieved by applying an auxiliary printing medium to the attachment regions.

17 Claims, 6 Drawing Sheets

(51) Int. Cl.

| | |
|---|---|
| ***B31B 50/74*** | (2017.01) |
| *B31B 110/35* | (2017.01) |
| *B31B 100/00* | (2017.01) |
| *B31B 120/10* | (2017.01) |
| *B31B 110/30* | (2017.01) |

(52) U.S. Cl.
CPC ..... *B31B 50/742* (2017.08); *B31B 2100/00* (2017.08); *B31B 2100/0028* (2017.08); *B31B 2110/30* (2017.08); *B31B 2110/35* (2017.08); *B31B 2120/102* (2017.08); *B31B 2241/003* (2013.01)

(56) References Cited

U.S. PATENT DOCUMENTS

| | | | | |
|---|---|---|---|---|
| 2009/0242434 | A1* | 10/2009 | Ghini | B65D 85/1081 206/246 |
| 2016/0176143 | A1* | 6/2016 | Knauf | B31B 50/62 493/82 |
| 2019/0291378 | A1* | 9/2019 | Thesing | B31B 50/26 |

OTHER PUBLICATIONS

International Search Report for Application No. PCT/EP2017/074310 dated Oct. 25, 2017.

* cited by examiner

BLANK FOR FORMING A CONTAINER

CROSS-REFERENCE TO RELATED APPLICATIONS

The present application is a national phase entry under 35 U.S.C. § 371 of International Application No. PCT/EP2017/074310, filed Sep. 26, 2017, published in English, which claims priority to European Application No. 16191136.7 filed Sep. 28, 2016, the disclosures of which are incorporated herein by reference.

BACKGROUND OF THE INVENTION

The present invention relates to a blank, a container, and respective methods for forming a blank and a container.

Typically, containers for smoking articles are formed from blanks made out of paper or card. In order to form a container the blanks are bent and/or folded around a charge of smoking articles. The blanks are then glued together at dedicated overlap regions so as to form the container. The blanks can be laminated, typically by having a base board made out of paper or card, and a laminate layer made out of aluminium foil or PET foil.

FIG. 1 is a perspective view of a container 2 having a lid 4, a front panel 6 and side panels 8, 10. One side of the blank, including surfaces that will be outward facing in the container, is typically printed before the container formation process is undertaken. During this printing process, inks, varnishes, lacquers, or a combination thereof, are applied to the blanks to create a design and include legally required information, such as health warnings, or manufacturing details. The reverse side of the blank, including surfaces that will be inward facing, is typically (but not necessarily) unprinted. The blanks include overlapping flaps, such as those on the side panels 8, 10, whereby a flap on one surface of the blank is glued to a flap on an opposite surface of the blank to form the container 2.

Containers are typically assembled at high speeds of up to 1,000 per minute. At these speeds it has been found that problems can arise in the integrity of the bond between overlapping flaps. In extreme circumstances the bonded flaps may detach, meaning that the container may fall apart. It has been found that laminated blanks are most sensitive to this problem.

FIG. 2 is a perspective view of a container 102 in which bonded flaps have become detached. During assembly, a side panel 112 on a printed side of the blank is initially glued to a side panel 114 on an unprinted side of the blank. The respective side panels 112, 114 have become detached in the perspective view shown in FIG. 2. A fibre tear may occur in a blank made of a fibrous material such as paper or card if the side panels 112, 114 are separated and the adhesive has maintained its integrity. In these circumstances the blank material would tear and shreds of fibre would be likely to be found on the detached side panels 112, 114. Notably, no fibre tear or material transfer is evident from the surfaces of the side panels 112, 114 in the arrangement of FIG. 2, which may be indicative of a failure of the adhesive.

One option for circumventing this problem is to use more complex adhesives, which undesirably increase the cost of manufacture. Another option is to reduce the speed of assembly in order to give more time for bonds to adhere, which also increases manufacturing costs.

BRIEF SUMMARY OF THE INVENTION

An object of the present invention is to provide a blank with surfaces that can be bonded more effectively, without otherwise interfering in the assembly process.

According to an aspect of the present invention there is provided a method of printing a blank for forming a container, comprising the steps of: providing a blank having first and second, opposite surfaces, where the first surface has at least one attachment region for attachment to the second surface at a corresponding attachment region during assembly of a container, wherein the first blank surface has a surface tension in a predetermined range, suitable for application of an adhesive; applying a main substance onto at least the first blank surface to obtain at least one printed surface; and treating the attachment region of the first blank surface to maintain a surface tension in the predetermined range.

It has been found that surface tension is an important factor in determining the integrity of a bond. It has also been found that the application of a main substance on the first blank surface may, without counter measures being taken, reduce surface tension in the attachment regions such that it is outside the predetermined range and unsuitable for application of an adhesive. By treating the attachment region it is possible to counteract these undesirable effects and to maintain surface tension in the predetermined range. Thus, treating the attachment region can provide better conditions for an adhesive and decreased risk of detachment, even in high speed manufacturing processes. The surface tension of the attachment region before the application of a main substance and after treatment do not need to be the same; both surface tensions, before and after, need to be comprised within a predetermined range, suitable for application of an adhesive, but their values can differ.

The blank may be provided in a cut or in an uncut form. In an uncut form, the blank is provided as a sheet of material suitable to form the container, such as a paper or card, and, during or after the printing process, the sheet is cut, for example, die cut, to the shape that will be used to form the container. In a cut form, the blank is provided cut from the sheet of material to the shape that will be used to form the container. Alternatively, the blank may be provided cut from the sheet of material to the external shape that will be used to form the blank, and other cuts and crease or score lines will be performed during or after the printing process.

The blank may have a number of different regions each of which exhibit different surface tension values. This may be a result of different design features on the blank and/or the use of different inks or printing materials. The attachment region is active in bonding using an adhesive, and therefore it is believed that the surface tension value in the attachment region is most relevant to the integrity of the eventual bond.

The main substance may be selected from the group of an ink, a varnish, a lacquer or a combination thereof and is applied onto the first blank surface, having the attachment region with a surface tension in the predetermined range. The main substance is preferably not applied in the attachment regions. Nevertheless the application process may affect the surface tension in the attachment regions, in the absence of counter measures. It has been found that treatment of the attachment regions can control the surface tension to enable effective bonding at high speeds.

The predetermined range may be between 34 dynes/cm and 60 dynes/cm, for example, between 36 dynes/cm and 50 dynes/cm. It has been found that a surface tension of less than around 34 dynes/cm yields unsatisfactory bonding at high speeds of manufacture.

The step of treating the attachment region may involve applying a medium to the attachment region or physically manipulating the attachment region to maintain a surface tension in the predetermined range.

The treatment of the attachment region may include a non-treated area for inclusion of printing reference marks to evaluate printing tolerances, such as malalignment of blanks in the different printing steps, or colour deviation.

The step of treating the attachment region of the at least one printed surface may involve discharging a gas, a plasma, a high voltage, or a combination thereof onto the attachment region. Alternatively, or in addition, the step of treating the attachment region of the at least one printed surface may involve scorching, grating, or abrading the attachment region, or any combination thereof.

The step of treating the attachment region of the first blank surface may involve applying an auxiliary substance. The auxiliary substance may be selected from the group of an ink, a varnish, a lacquer or a combination thereof. Typically the attachment region of the first blank surface is unprinted to improve bonding integrity. Surprisingly it has been found that applying an auxiliary substance can improve bonding integrity and maintain a surface tension in the predetermined range following application of the main substance.

The auxiliary substance may also be applied to other regions of the first blank surface as part of the main substance. Thus, the main substance may comprise the auxiliary substance in certain embodiments.

The auxiliary substance may be applied to the attachment region of the first blank surface at the same time as the main substance is applied to the first blank surface. Alternatively the auxiliary substance may be applied before or after application of the main substance. The combined effect of application of the main substance onto the first blank surface and the auxiliary substance onto the attachment region of the first blank surface may result in a surface tension in the attachment region that is within the predetermined range. In one arrangement, the step of applying the main substance onto at least the first blank surface may reduce the surface tension of the attachment region of the first blank surface so that it is outside the predetermined range, and the step of treating the attachment region of the first blank surface may increase the surface tension so that it is within the predetermined range.

The auxiliary substance may be applied over discontinuous areas of the attachment region. In one example, the discontinuous areas may be spots or dots, in any convenient pattern, shape or arrangement. The auxiliary substance may also be applied in a regular distribution.

The auxiliary substance may be applied onto between 10% and 97% of the surface of the attachment region, preferably between 15% and 85%, most preferably between 22% and 72%. Surprisingly, it has been found that good bonding results are achieved for less than 100% coverage of the surface area of the attachment region with the auxiliary substance. In one embodiment particularly good bonding results are achieved with 40% coverage. It is anticipated that different optimal values would be achieved with different patterns and types of auxiliary substance.

The auxiliary substance may comprise solid particles dispersed throughout a fluid, the largest solid particle size comprised between 1 micrometer and 40 micrometers, for example, between 4 micrometers and 35 micrometers.

The method may comprise forming a plurality of score lines or perforations in the attachment regions of the at least one printed surface. Score lines have been found previously to improve adhesion by increasing absorption of an adhesive in the attachment region during bonding.

According to another aspect of the present invention there is provided a blank for forming a container, comprising: first and second, opposite surfaces, where the first surface has at least one attachment region for attachment to the second surface at a corresponding attachment region during assembly of a container; and a main substance applied on the first blank surface to obtain at least one printed surface, wherein, before application of the main substance, the first blank surface has a surface tension in a predetermined range, suitable for application of an adhesive, and wherein the attachment region of the first blank surface is treated to maintain a surface tension within the predetermined range, following application of the main substance. In the blank, the predetermined range may be between 34 dynes/cm and 60 dynes/cm, for example, between 36 dynes/cm and 50 dynes/cm.

According to yet another aspect of the present invention there is provided a container comprising: first and second, opposite surfaces, where the first surface has at least one attachment region for attachment to the second surface at a corresponding attachment region; a main substance applied on the first surface to obtain a printed surface, wherein before application of the main substance the first blank surface has a surface tension in a predetermined range, suitable for application of an adhesive, and wherein the attachment region of the first blank surface is treated to maintain a surface tension within the predetermined range, following application of the main substance; and an adhesive provided on the treated attachment region, wherein the first and second blank surfaces overlap at the corresponding attachment regions with the adhesive provided therebetween.

According to yet another aspect of the present invention there is provided a method of forming a container comprising the steps of: providing the blank as defined above; providing an adhesive to the treated attachment region; folding the blank to form a container such that the first and second blank surfaces overlap at the corresponding attachment regions with the adhesive therebetween; and bonding the corresponding attachment regions together with the adhesive.

According to yet another aspect of the invention there is provided a method of printing a blank for forming a container, comprising the steps of: providing a blank having first and second, opposite surfaces, where the first surface has at least one attachment region for attachment to the second surface at a corresponding attachment region during assembly of a container; applying a main substance onto at least the first blank surface to obtain at least one printed surface; and treating the attachment region of the first blank surface to provide a surface tension in the attachment region of between 34 dynes/cm and 60 dynes/cm.

The blank may be a laminated blank comprising a base board made of paper or card, and a laminate layer, preferably aluminium foil or plastic foil, such as, for example, PET, PE, or PP. The laminated blank may additionally comprise a second laminate layer, equal to or different from the first laminate layer, with the base board positioned between the first and second laminate layers.

Apparatus features may be provided as method features and vice-versa.

BRIEF DESCRIPTION OF THE DRAWINGS

The present invention will now be described, by way of example, with reference to the accompanying drawings in which.

DETAILED DESCRIPTION

Figure 3:
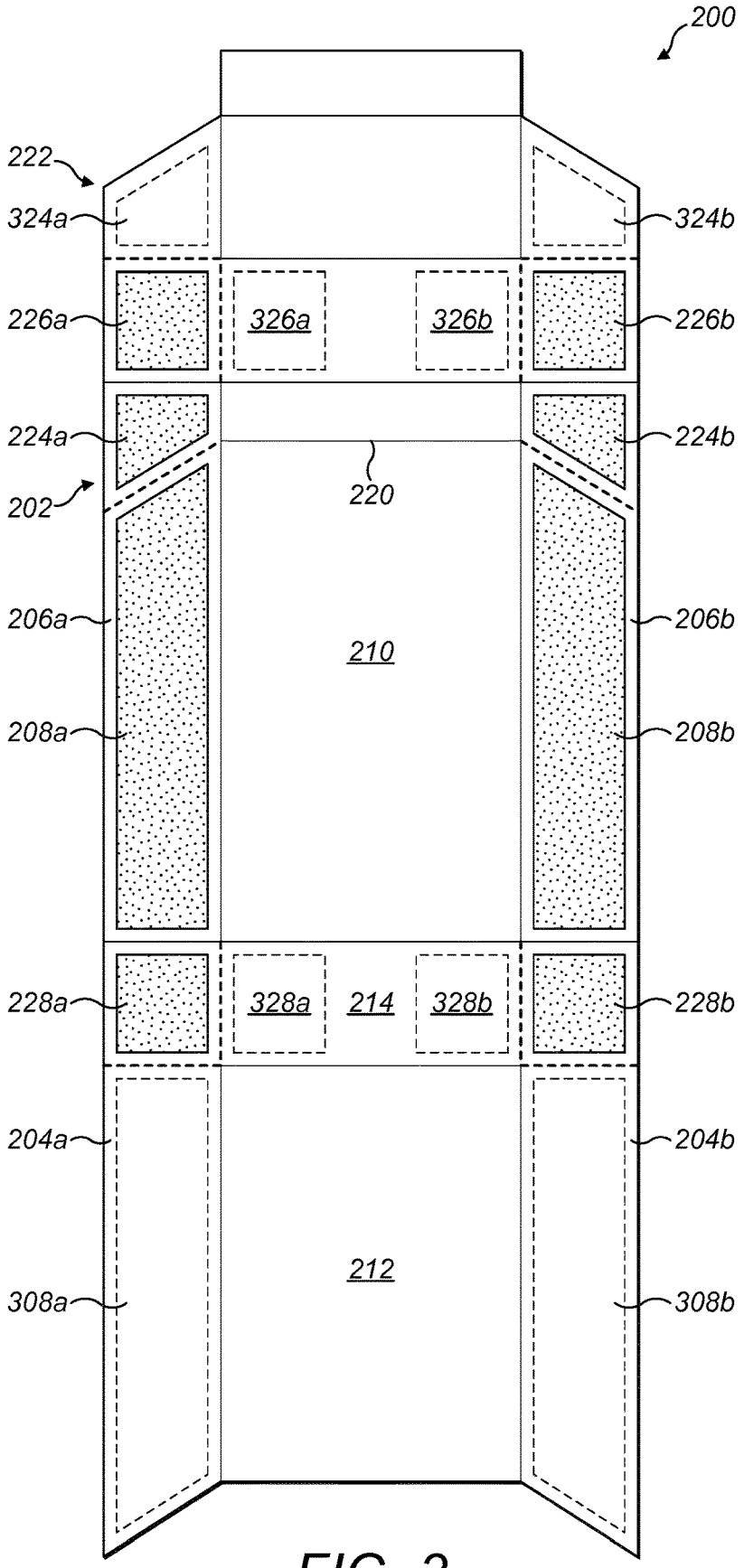
FIG. 3 is a plan view of a blank for producing a container for smoking articles in an embodiment of the present invention.

FIG. 3 is a plan view of an upper surface 202 of a blank 200. The upper surface 202 of the blank is printed in a conventional manner using an ink, varnish, lacquer, or a combination thereof, to create a design and include legally required information, such as health warnings, or manufacturing details. The reverse surface of the blank 200 is unprinted in this embodiment. However, it is possible that the reverse surface could also be printed, at least partially, so that internal surfaces of the container include designs or information.

The blank 200 includes cut lines (indicated with dotted lines in FIG. 3) and fold lines (indicated with solid lines in FIG. 3). A hinge line 220 is provided between a lid 222 and the remainder of the pack. The upper surface 202 of the blank 200 includes a front panel 210, a back panel 212 and a bottom panel 214. When the blank 200 is folded and formed around a bundle of smoking articles, the front panel 210, back panel 212 and bottom panel 214 are outward facing. The upper surface 202 of the blank also includes outer side panels 204*a,b* and inner side panels 206*a,b*.

A plurality of attachment regions 208*a,b*, 224*a,b*, 226*a,b*, 228*a,b* are provided on the upper surface 202 of the blank 200 for attachment to the reverse surface of the blank 200 at corresponding attachment regions 308*a,b*, 324*a,b*, 326*a,b*, 328*a,b* on the reverse surface of the blank 200 (shown in phantom in FIG. 3). The attachment regions 208*a,b*, 224*a,b*, 226*a,b*, 228*a,b* are generally unprinted, except for printing reference marks to evaluate printing tolerances, such as malalignment of blanks in the different printing steps, or colour deviation. The entire reverse surface of the blank 200 is generally unprinted. During assembly, the attachment regions 208*a,b*, 224*a,b*, 226*a,b*, 228*a,b* on the upper surface 202 of the blank 200 are arranged to face the reverse surface of the blank at their corresponding attachment regions 308*a,b*, 324*a,b*, 326*a,b*, 328*a,b* on the reverse surface. An adhesive is provided at the attachment regions 208*a,b*, 224*a,b*, 226*a,b*, 228*a,b* of the upper surface 202 of the blank 200 to create a bond between the corresponding attachment regions.

Figure 1:
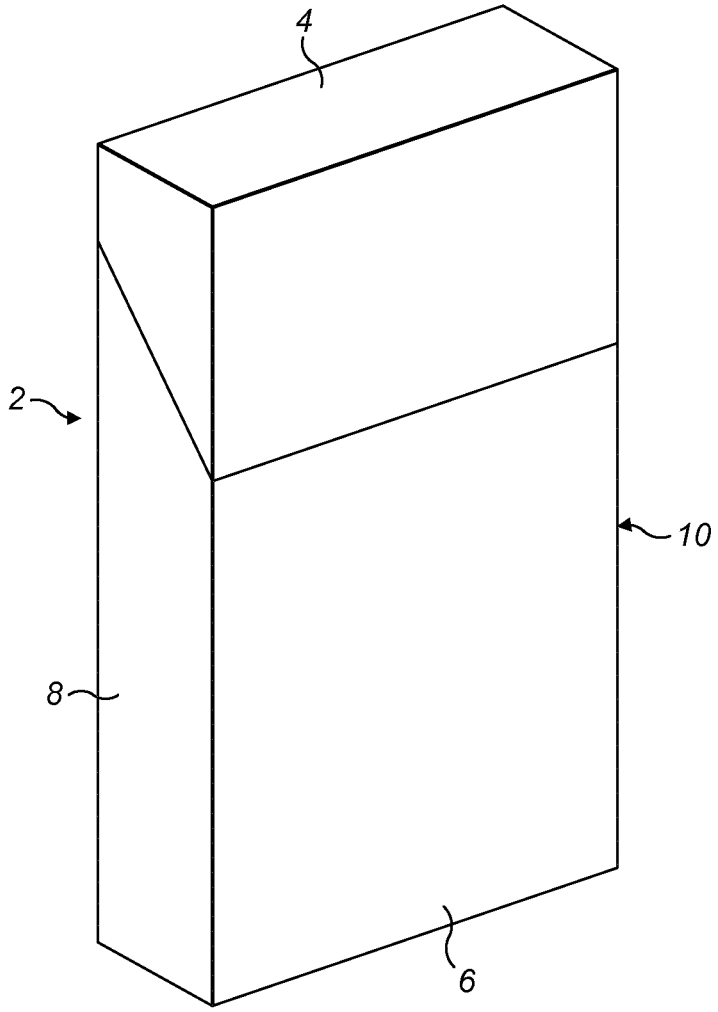
FIG. 1 is a perspective view of a container for smoking articles.
Figure 2:
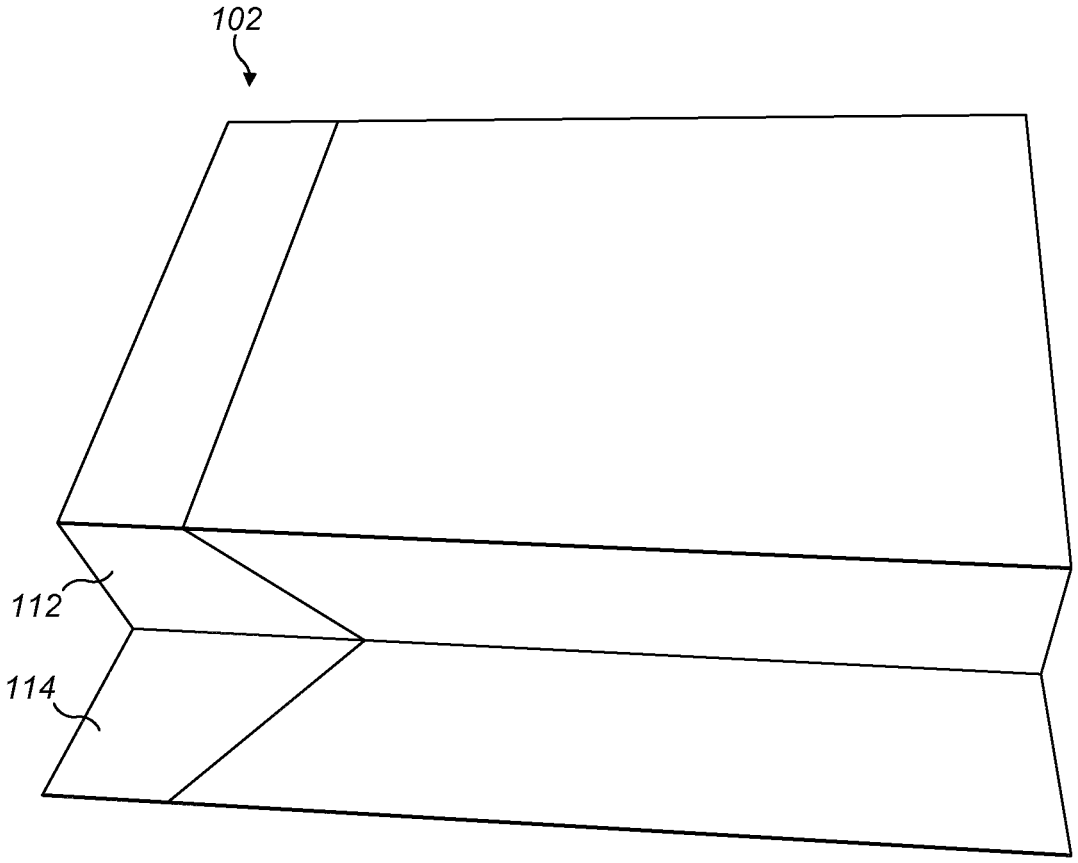
FIG. 2 is a perspective view of a container for smoking articles where bonded surfaces have become detached.

In order to form a container, such as the one represented in FIG. 1, the blank 200 is folded in a conventional manner. For example, during folding the outer side panels 204*a,b* are folded onto the inner side panels 206*a,b* so that the attachment regions 208*a,b* are brought against the reverse surface of the outer side panels 204*a,b* at their corresponding attachment regions 308*a,b*. Thus, in the formed container the printed upper surface 202 of the outer side panels 204*a,b* is presented as an exterior surface.

It has been found that the properties of the attachment regions 208*a,b*, 224*a,b*, 226*a,b*, 228*a,b* on the upper surface 202 are an important factor in determining the integrity of the adhesive bond. One important property appears to be the surface tension of the of the attachment regions 208*a,b*, 224*a,b*, 226*a,b*, 228*a,b* after the upper surface 202 has been printed. The unprinted blank 200 has a surface tension in the range between 34 dynes/cm and 60 dynes/cm, and most preferably between 36 dynes/cm and 50 dynes/cm. However, experimental results suggest that, following the printing process, the surface tension in the attachment regions 208*a,b*, 224*a,b*, 226*a,b*, 228*a,b* can be below 34 dynes/cm, leading to bond integrities that are below the required standard. Even though the attachment regions 208*a,b*, 224*a,b*, 226*a,b*, 228*a,b* are unprinted it is currently believed that the process of printing the upper surface 202 can negatively impact surface tension values in the attachment regions 208*a,b*, 224*a,b*, 226*a,b*, 228*a,b*, leading to poor bonding in formed containers, in the absence of counter measures.

In the present method, the attachment regions 208*a,b*, 224*a,b*, 226*a,b*, 228*a,b* 208*a,b* of the upper surface 202 are treated in order to ensure that, following the printing process, their surface tension is in the range of 34 dynes/cm to 60 dynes/cm, before any adhesive is applied. This is achieved by a further printing step (which may be simultaneous) during which an auxiliary printing medium is applied to the attachment regions 208*a,b*, 224*a,b*, 226*a,b*, 228*a,b*. In alternative techniques, the attachment regions 208*a,b*, 224*a,b*, 226*a,b*, 228*a,b* may be treated by application of a gas, a plasma or a current, or by scorching, grating, or abrading. It is believed that these techniques (or any combination thereof) may be deployed in order to yield a surface tension in the desired range, above around 34 dynes/cm and below around 60 dynes/cm. In case printing reference marks are provided in any of the attachment regions, the areas reserved to them are left untreated.

The auxiliary printing medium is an ink, varnish, lacquer, or a combination thereof, comprising solid particles dispersed throughout a fluid. The largest solid particle size is comprised between 1 micrometer and 40 micrometers, typically between 4 micrometers and 35 micrometers. The largest solid particle size can be measured with a grindometer. The auxiliary printing medium may comprise one of the inks, varnishes or lacquers used for printing other regions of the upper surface 202.

Figure 4:
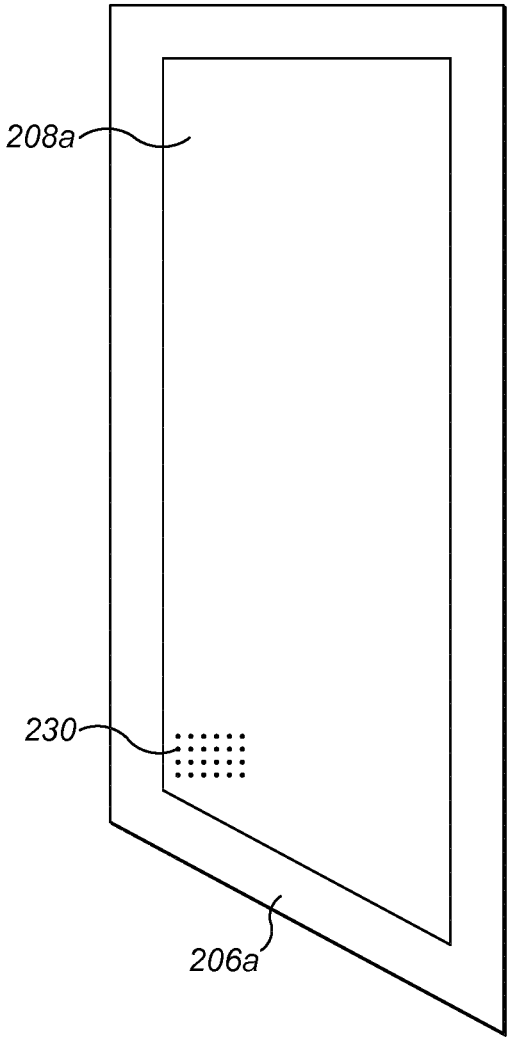
FIG. 4 is a detailed plan view of an attachment region in an inner side panel on the blank shown in FIG. 3.

The auxiliary printing medium is applied in a pattern on the attachment regions 208*a,b*, 224*a,b*, 226*a,b*, 228*a,b*. FIG. 4 is a plan view of one of the attachment regions 208*a*, although it will be appreciated that the other attachment regions may be treated in a similar way. In this embodiment the attachment region 208*a* is printed with the auxiliary printing material in a pattern of regularly spaced spots 230. The size, spacing and pattern produced by the spots 230 may be varied to achieve different results. In some embodiments individual spots 230 may be invisible to the naked eye due to their small size. In alternative arrangements the auxiliary medium may be printed with lines, swirls, dots or any combination of these to achieve a desired pattern.

The size and density of spots 230 is controlled in order to provide a preselected surface area coverage of auxiliary material in the attachment regions 208*a,b*, 224*a,b*, 226*a,b*, 228*a,b*. Experimental results suggest that the best bond integrities can be achieved with auxiliary material surface area coverage in the range of 10% to 97%, preferably 15% to 85%, and most preferably 22% to 72%.

A number of test blanks have been analysed to determine relative bonding strength for different surface area coverage of auxiliary material, and the results are set out in the table below.

| Surface area coverage with auxiliary material[%] | $F_{max}$ Value (N) | $F_{max}$ std dev | $F_{max}$ ΔF (%) | $F_{break}$ Value (N) | $F_{break}$ std dev | $F_{break}$ ΔF (%) |
|---|---|---|---|---|---|---|
| 0 | 3.61 | 1.390 | 0.000 | 1.520 | 1.750 | 0.000 |
| 40 | 5.44 | 1.390 | 50.693 | 1.090 | 0.279 | −28.289 |
| 70 | 5.11 | 1.750 | 41.551 | 1.990 | 1.540 | 30.921 |
| 100 | 4.26 | 1.720 | 18.006 | 1.910 | 1.590 | 25.658 |

The table records $F_{max}$ and $F_{break}$ at four different values for the percentage of the attachment regions 208*a,b*, 224*a,b*, 226*a,b*, 228*a,b* covered in the auxiliary material. $F_{max}$ is the measured force at which the adhesive fails, and therefore $F_{max}$ is considered to be a measure of the strength of the bond between respective attachment regions 208*a,b*, 308*a,b*. $F_{break}$ is the measured force at which tearing occurs between respective attachment regions 208*a,b*, 308*a,b*. ΔP is the change in bonding strength, relative to 0% coverage of surface area with the auxiliary material, and expressed as a percentage. ΔP is calculated according to the following formula:

$$\Delta F = \frac{F_{max,0\%} - F_{max,X\%}}{F_{max,0\%}}$$

where $F_{max,\ 0\%}$ is the bonding strength with 0% surface area coverage with the auxiliary material and $F_{max,\ X}\%$ is bonding strength with X % coverage with the auxiliary material.

Figure 5:
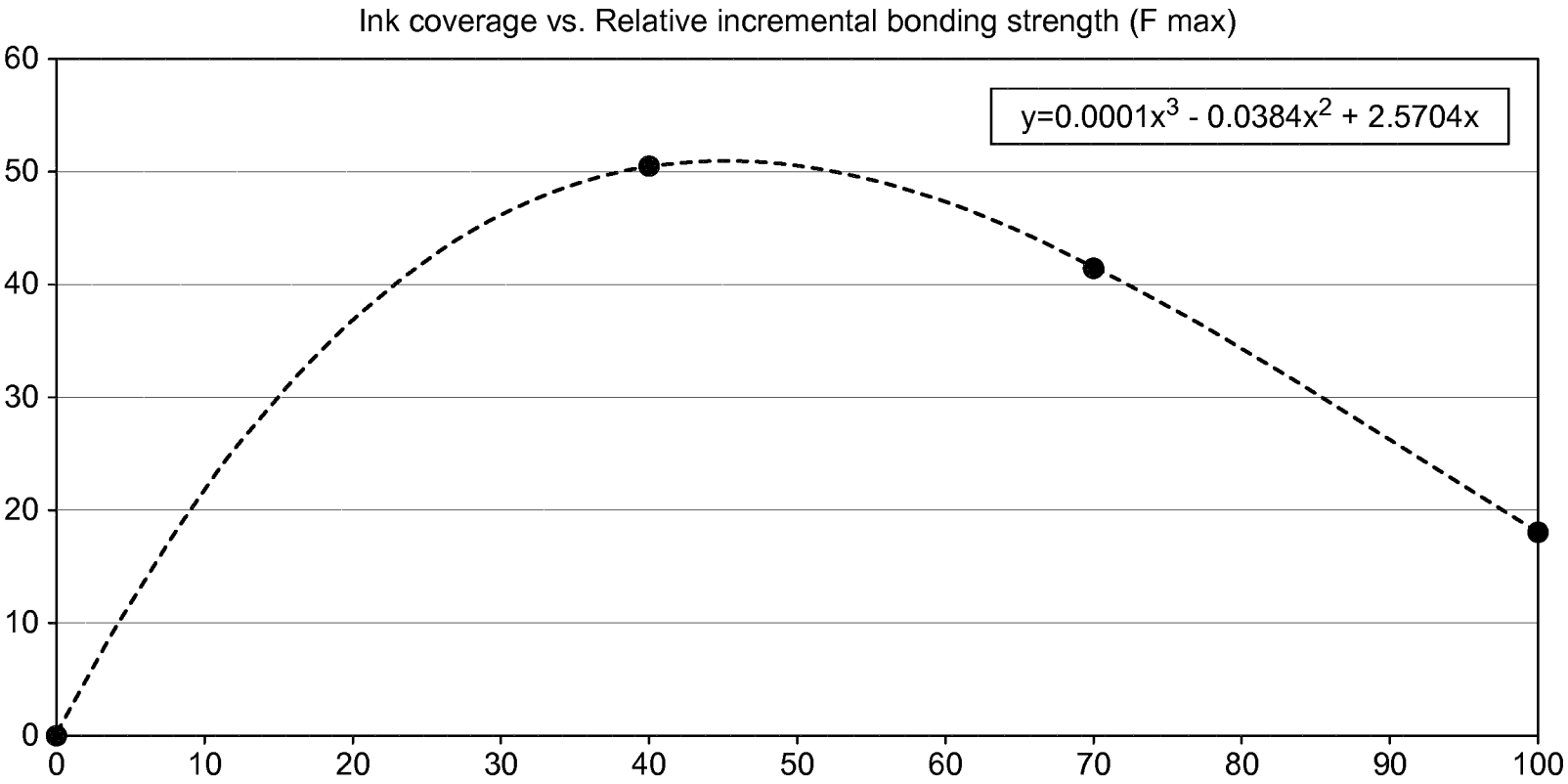
FIG. 5 is a graph showing relative bonding strength for surfaces in a container versus the area of an attachment region coated in an auxiliary substance.

FIG. 5 is a graph showing ΔP versus the surface area of an attachment region 208*a,b*, 224*a,b*, 226*a,b*, 228*a,b* coated in an auxiliary substance. The graph includes a third order polynomial trend line. It can be appreciated that the best results are achieved for less than 100% coverage. This is achieved with an even distribution of spots 210 across the relevant attachment region 208*a,b*, 224*a,b*, 226*a,b*, 228*a,b*.

The table below indicates the surface area coverage that is required to provide>20%, >30% and >40% improvements in bonding strength relative to 0% coverage with the auxiliary material in the attachment region 208*a,b*, 224*a,b*, 226*a,b*, 228*a,b*.

| ΔF (%) | Auxiliary material surface area coverage (%) |
|---|---|
| >20% | 9%-97% |
| >30% | 15%-85% |
| >40% | 22-72% |

The attachment regions may be perforated or scored before or after the attachment regions 208*a,b*, 224*a,b*, 226*a,b*, 228*a,b* are treated by printing with the auxiliary material. This may improve water absorption in the attachment regions 208*a,b*, 224*a,b*, 226*a,b*, 228*a,b* which may improve the action of the adhesive.

During assembly an adhesive is applied to the attachment regions 208*a,b*, 224*a,b*, 226*a,b*, 228*a,b* on the upper surface 202. The attachment regions 208*a,b*, 224*a,b*, 226*a,b*, 228*a,b* are then brought against the reverse surface of the panels of the lid 222 and the outer side panels 204*a,b* at their corresponding attachment regions 308*a,b*, 324*a,b*, 326*a,b*, 328*a,b* and pressed together so that the panels can be bonded. The adhesive is generally applied across the full area of the relevant attachment regions.

The surface tension of the attachment regions 208*a,b*, 224*a,b*, 226*a,b*, 228*a,b* that have been treated with the auxiliary material can be measured according to standard techniques. One technique involves the use of test inks. According to this technique, a test ink is selected with a characteristic surface tension value, which has been manufactured according to DIN Draft 53364 or ISO 8296. In this technique the test ink is applied to the surface of the relevant attachment regions 208*a,b*, 224*a,b*, 226*a,b*, 228*a,b* with a brush or a pen filled in with the test ink. Alternatively, a drop of the test ink may be dropped at the relevant attachment regions 208*a,b*, 224*a,b*, 226*a,b*, 228*a,b*. The liquid in the test ink will either form a continuous film on the surface or else it will pull back into small droplets. If the test ink remains as a film for two seconds, then it is determined that the substrate has a surface tension which is at least that of the characteristic surface tension of the test ink. Should the test ink reticulate or draw back into droplets in less than two seconds, then it is determined that the surface tension of the substrate is lower than the characteristic surface tension of the test ink. It is recommended to apply the test ink to draw a line with a minimum length of 5 mm, preferably of 10 mm, that does not traverse printing reference marks, to properly visualise the behaviour of the test ink. The precise surface tension is determined by applying a number of test inks with increasing or decreasing characteristic surface tension values until the surface tension of the substrate can be accurately determined. This technique can provide a value for the surface tension of the attachment regions 208*a,b*, 224*a,b*, 226*a,b*, 228*a,b* following treatment with an accuracy of ±2 dynes/cm.

In case the attachment region is treated by printing a pattern of lines, swirls, dots, or a combination thereof, surface tension may be measured over an area that is larger than the area of any individual element. This is especially true when the individual elements are too small to be distinguished by naked eye. In case the printed pattern consists of parallel lines, surface tension should be measured by drawing a line substantially perpendicular to the printed parallel lines to ensure that printed lines are traversed.

Figure 6:
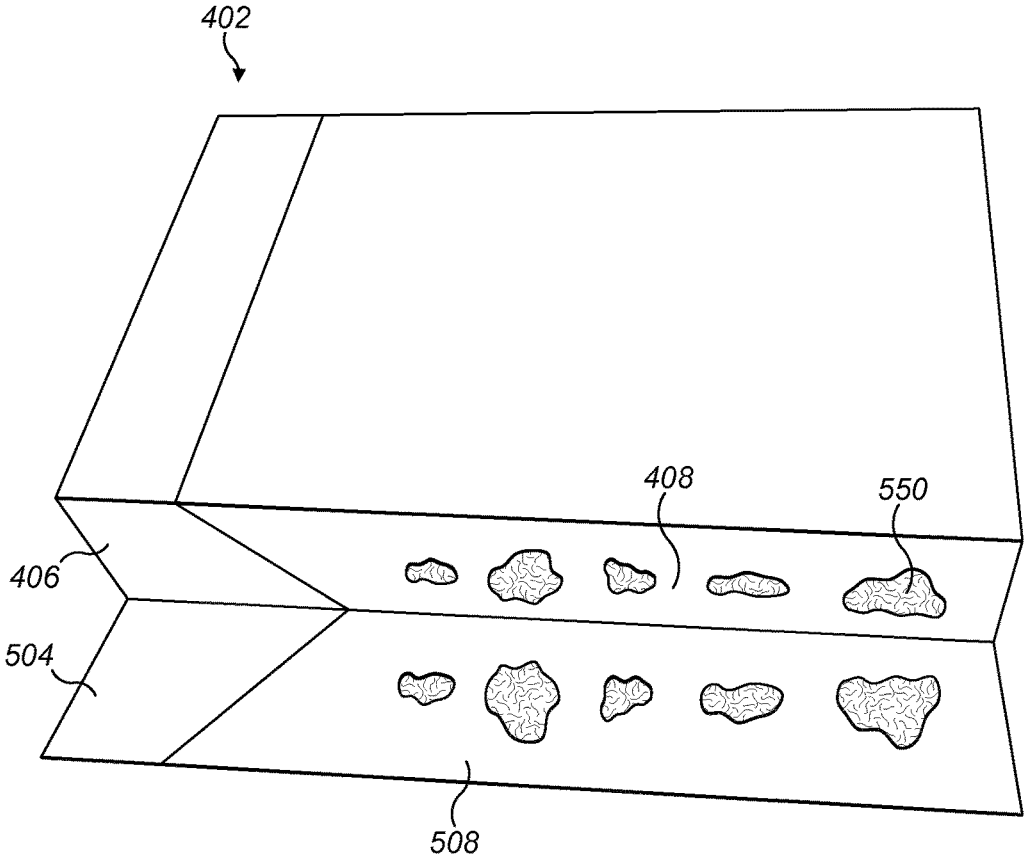
FIG. 6 is another perspective view of a container for smoking articles where bonded surfaces have been detached in an experiment.

Another technique can be performed with the naked eye to determine the surface tension of the attachment regions 208*a,b*, 224*a,b*, 226*a,b*, 228*a,b* following treatment. According to this technique, bonded panels can be manually pulled apart twenty-four hours after they have been bonded together. The exposed attachment regions 208*a,b*, 224*a,b*, 226*a,b*, 228*a,b* on the upper surface 202 can then be visually inspected to determine whether there has been any material transfer from the attachment regions 308*a,b*, 324*a,b*, 326*a,b*, 328*a,b* on the lower surface. A material transfer would be visible where the paper has ripped and shreds of fibre from the attachment regions 308*a,b*, 324*a,b*, 326*a,b*, 328*a,b* on the lower surface are found on the attachment regions 208*a,b*, 224*a,b*, 226*a,b*, 228*a,b* on the upper surface 202. FIG. 6 is a perspective view of a container 402 for smoking articles where bonded surfaces have been detached in an experiment. In the container 402, an attachment region 408 on a printed inner side panel 406 was initially glued to an attachment region 508 of an unprinted outer side panel 504. The inner side panel 406 is manually separated from the outer side panel 504 and shreds of fibre 550 are evident on the attachment region 408 of the printed inner side panel 406, indicating that a material transfer has occurred. It has been determined that a material transfer is found where the surface tension in the attachment region 408 following treatment is between 34 dynes/cm and 60 dynes/cm. Therefore, a simple visual inspection can reveal whether the surface tension of the attachment regions 208*a,b* is above around 34 dynes/cm.

It has been determined that high quality bond provides a bonding strength that is higher than the breaking resistance of the blank material. Therefore, when a high quality bond is achieved separating the adhered surfaces results in material tear that is apparent on the surface of the attachment regions. A material tear is especially evident when the blank from which the container is formed is made from a fibre-based material, such as coated or uncoated cardboard. In the latter case, fibre remains will be apparent on the surface of the attachment regions if the bonding quality is high. Substantial coverage of the attachment region 408 with fibre remains following separation is a clear naked-eye indication that the surface tension of the attachment region 408 is above 34 dynes/cm. Conversely, if the bonding quality is poor because the attachment region has a surface tension of less than 34 dynes/cm or more than around 60 dynes/cm then no material transfer will be evident following separation.

The invention claimed is:

1. A method of printing a blank for forming a container, comprising the steps of:

providing a blank having first and second opposite surfaces, an unfolded condition and a folded condition, when the blank is in the unfolded condition the first surface has a panel disposed between a first attachment region and a second attachment region, the first and second attachment regions for receiving an adhesive, when the blank is in the folded condition each of the first and second attachment regions face the second surface of a corresponding attachment region such that the panel of the first surface forms an outer surface of the container and the first and second attachment regions of the first surface are provided inside the outer surface of the container, wherein the first blank surface has a surface tension in a predetermined range between about 34 dynes/cm and about 60 dynes/cm, suitable for application of the adhesive;

applying a main substance onto at least the first blank surface to obtain at least one printed surface, the main substance being an ink, a varnish, a lacquer, or a combination thereof; and treating the first and second attachment regions of the first blank surface to maintain a surface tension in the predetermined range by applying an auxiliary substance comprising an ink, a varnish, a lacquer or a combination thereof to an external surface of the first and second attachment regions of the first blank surface, applying an adhesive to the first and second attachment regions of the first blank surface after the step of treating the first and second attachment regions of the first blank surface.

2. The method according to claim 1, wherein the auxiliary substance is applied simultaneously with the main substance.

3. The method according to claim 1, wherein the auxiliary substance is applied over discontinuous areas of the first and second attachment regions of the first blank surface.

4. The method according to claim 1, wherein the auxiliary substance is applied in a regular distribution on the first and second attachment regions of the first blank surface.

5. The method according to claim 1, where the auxiliary substance is applied onto between 10% and 97% of the surface of the first and second attachment regions of the first blank surface.

6. The method according to claim 1, wherein the auxiliary substance comprises solid particles dispersed throughout a fluid, the largest solid particle size comprised between 1 micrometer and 40 micrometers.

7. The method according to claim 1, further comprising a step of forming a plurality of score lines or perforations in the first and second attachment regions of the at least one printed surface.

8. The method according to claim 1 wherein the predetermined range is between 36 dynes/cm and 50 dynes/cm.

9. The method according to claim 1, where the auxiliary substance is applied onto between 15% and 85% of the surface of the first and second attachment regions of the first blank surface.

10. The method according to claim 1, where the auxiliary substance is applied onto between 22% and 72% of the surface of the first and second attachment regions of the first blank surface.

11. The method according to claim 1, wherein the auxiliary substance comprises solid particles dispersed throughout a fluid, the largest solid particle size comprised between 4 micrometers and 35 micrometers.

12. A blank for forming a container, comprising:

first and second opposite surfaces, when the blank is in an unfolded condition the first surface has a panel disposed between a first attachment region and a second attachment region, the first and second attachment regions for receiving an adhesive, when the blank is in a folded condition each of the first and second attachment regions face the second surface of a corresponding attachment region such that the panel forms an outer surface of the container and the first and second attachment regions are provided inside the outer surface of the container; and a main substance applied on the first surface to obtain a printed surface, the main substance being an ink, a varnish, a lacquer, or a combination thereof, wherein before application of the main substance the first blank surface has a surface tension in a predetermined range between about 34 dynes/cm and about 60 dynes/cm, suitable for application of the adhesive, and wherein the first and second attachment regions of the first blank surface are treated to maintain a surface tension within the predetermined range by applying an auxiliary substance comprising an ink, a lacquer, or a combination thereof to an external surface of the first and second attachment regions of the first blank surface.

13. The blank for forming a container according to claim 12, wherein the blank is a laminated blank comprising a base board and a laminate layer, and wherein the laminate layer is the first surface.

14. A method of forming a container comprising the steps of:

providing the blank according to claim 12;

providing the adhesive to the treated first and second attachment regions;

folding the blank to form a container such that the first surface of the first and second attachment regions overlap the second surface of the corresponding attachment regions with the adhesive therebetween; and bonding the first surface of the first and second attachment regions to the second surface of the corresponding attachment regions together with the adhesive.

15. The method of claim 14, wherein the folding step comprises folding the blank around one or more smoking articles.

16. A container comprising:

first and second opposite surfaces, when the container is in an unfolded condition the first surface has a panel disposed between a first attachment region and a second attachment region, the first and second attachment regions for receiving an adhesive, when the container is in the folded condition each of the first and second attachment regions face the second surface of a corresponding attachment region such that the panel forms an outer surface of the container and the first and second attachment regions are provided inside the outer surface of the container;

a main substance applied on the first surface to obtain a printed surface, the main substance being an ink, a varnish, a lacquer, or a combination thereof, wherein before application of the main substance the first blank surface has a surface tension in a predetermined range between about 34 dynes/cm and about 60 dynes/cm, suitable for application of the adhesive, and wherein the first and second attachment regions of the first blank surface are treated to maintain a surface tension within the predetermined range by applying an auxiliary substance comprising an ink, a varnish, a lacquer, or a combination thereof to an external surface of the first and second attachment regions of the first blank surface, following application of the main substance; and the adhesive provided on the treated first and second attachment regions, wherein the first and second blank surfaces overlap at the corresponding attachment regions with the adhesive provided therebetween.

17. The container of claim 16, wherein when the container is in the unfolded condition, the first surface further comprises another panel disposed between a third attachment region and a fourth attachment region provided on an opposite side of the another panel from the third attachment region, each of the third and fourth attachment regions for attachment to the second surface of another corresponding attachment region when the container is in the folded condition.

* * * * *